US007266050B2

(12) United States Patent
Eisenegger et al.

(10) Patent No.: US 7,266,050 B2
(45) Date of Patent: Sep. 4, 2007

(54) DEVICE FOR DATE INDICATION

(75) Inventors: Kilian Eisenegger, Stetten (CH); Denis Zimmermann, Kleinandelfingen (CH)

(73) Assignee: Richemont International SA, Villars-sur-Glane (CH)

( * ) Notice: Subject to any disclaimer, the term of this patent is extended or adjusted under 35 U.S.C. 154(b) by 539 days.

(21) Appl. No.: 10/937,408

(22) Filed: Sep. 10, 2004

(65) Prior Publication Data

US 2005/0056691 A1 Mar. 17, 2005

(30) Foreign Application Priority Data

Sep. 11, 2003 (EP) ..... 03020661

(51) Int. Cl.
*G04B 19/20* (2006.01)
*G04B 19/24* (2006.01)

(52) U.S. Cl. ..... 368/37

(58) Field of Classification Search ..... 368/28, 368/35–38

See application file for complete search history.

(56) References Cited

U.S. PATENT DOCUMENTS 3,716,983 A * 2/1973 Tanaka et al. ..... 368/28
4,257,113 A * 3/1981 Meister et al. ..... 368/35
5,469,410 A * 11/1995 Berney ..... 368/28
6,081,483 A * 6/2000 Capt et al. ..... 368/28
7,031,227 B2 * 4/2006 Huter ..... 368/27
2002/0024887 A1 * 2/2002 Triponez ..... 368/35

FOREIGN PATENT DOCUMENTS

| | | |
|---|---|---|
| CH | 310 559 | 10/1955 |
| EP | 0 191 921 | 8/1986 |
| EP | 0 529 191 | 3/1993 |

* cited by examiner

*Primary Examiner*—Vit W. Miska
(74) *Attorney, Agent, or Firm*—Young & Thompson

(57) ABSTRACT

A device for the date indication in a watch, with a digit disk and a decimal disk, which each include a sequence of figures or numbers and are arranged next to each other in parallel in such a manner that they overlap within the region of an indicating position and thus allow to represent a two digit number visible through a corresponding date window in the dial. The disk of larger diameter is a circular disk and the axis of rotation of the disk of smaller diameter is arranged within the outer peripheral contour of the disk of larger diameter. The device includes a digit programme wheel and a decimal programme wheel, which control via a digit pinion and a decimal pinion the switching operation of the digit disk and the decimal disk, and a programme drive wheel, which passes on the driving force onto the digit and decimal programme wheels.

17 Claims, 6 Drawing Sheets

DEVICE FOR DATE INDICATION

Figure 1A:
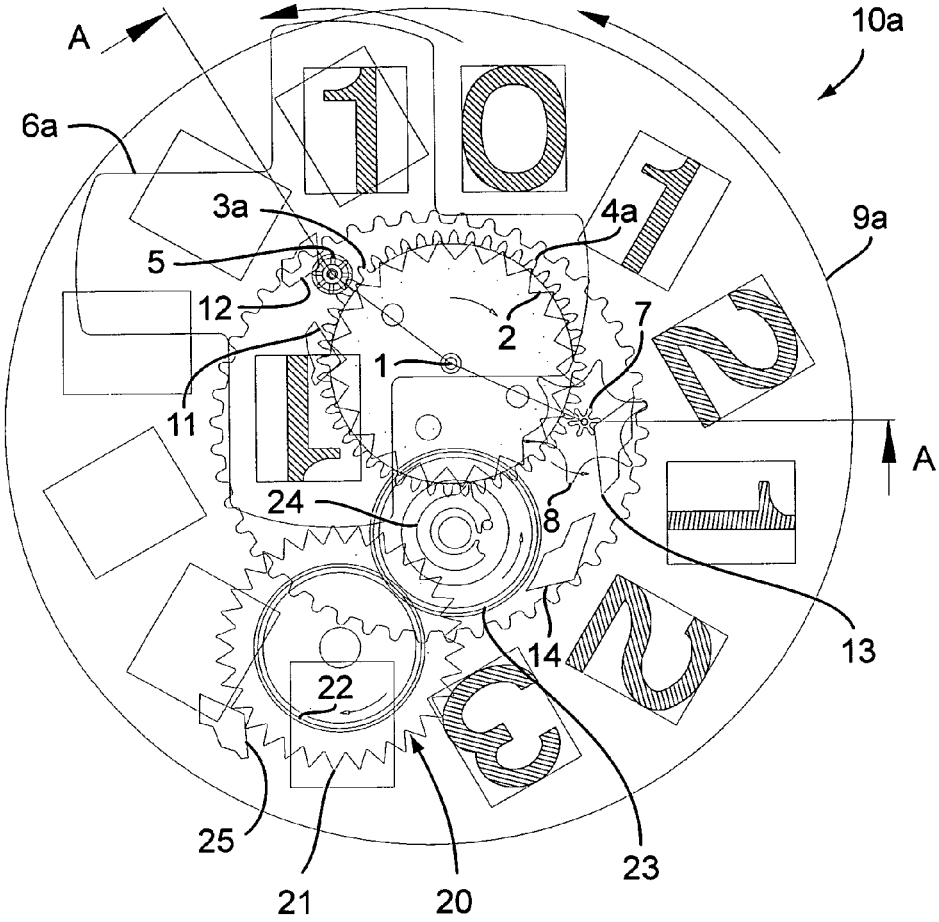

The present invention concerns a device for the date indication in a watch, in particular a wrist watch, with a digit disk and a decimal disk, which each comprise a sequence of figures or numbers and are arranged next to each other in parallel in such a manner that they overlap within the region of an indicating position and thus allow to represent a two digit number, which is visible through a corresponding date window in the dial of the watch, the disk of larger diameter being designed as a circular disk and the axis of rotation of the disk of smaller diameter being arranged within the outer peripheral contour of the disk of larger diameter, with a digit programme wheel as well as a decimal programme wheel, which by a digit pinion and a decimal pinion being each engaged with these control the switching operation of the digit disk and of the decimal disk, as well as with a programme drive wheel, which passes on the driving force onto the digit and the decimal programme wheel.

The invention refers in particular to mechanisms, which allow, particularly in wrist watches, to digitally indicate the date by large size. Such well-known mechanisms were used so far for the indication of the number of the day within a month. Some complicated watches however also allow to indicate, next to the number of the day, the day of the week, the month, the year and the decade as well as, if necessary, the century or a selection of these data. These indications can, in principle, be done differently, for example electronically, mechanically, by means of pointers or also in digital form. The large sized, digital indicator mechanisms mentioned above were used in different forms for the indication of the number of the day, like it is for example exposed in the patent specification EP 0 529 191. This document describes an embodiment of a device for the large sized indication of the number of the day by means of two disks lying on top of each other, a digit disk and a decimal disk, which comprise an arrangement specifically suitable for this purpose and likewise an adapted control device, in particular an adapted digit programme wheel as well as a decimal programme wheel. The document further contains a discussion of various other such mechanisms, which all are used for the indication of the number of the day and which reflect, despite the distance in time, the state of the art in this area.

From what has been said above, the problem results to make available, in particular for the mentioned complicated watches, a device which allows a digital indication by large size not for the number of the day, but for that of the month, this having to be realised on the one hand in an as simple, space-saving and efficient a way as possible regarding the drive of the device and on the other hand eventually in combination with the known indication of the number of the day.

The goal of the present invention is the realisation of the advantages specified above in order to solve the mentioned problem.

The subject of the present invention is characterised to this effect by the characteristics specified in claim 1.

By these measures, i.e. that the digit and the decimal programme wheel as well as the digit and the decimal disk are arranged accordingly, one obtains that the latter are subject to a switching operation of one step per month in a predetermined succession or instead are subject to a break in the switching operation. This allows, in contrast to the state of the art, the indication of the number of the month in digital large size.

The device can be driven in a simple manner by the motion-work. In a favourable way this device can however be driven and controlled instead of the motion-work by a perpetual calendar mechanism. Here, the digit and the decimal programme wheel can be integrated into the set of intermediate wheels belonging to the perpetual calendar mechanism. Moreover, also the known indication of the number of the day can be built into the mechanism, in order to be able to thus represent both the number of the day and that of the month in digital, large sized form, next to the number of the year.

These characteristics contribute to make available a simple and efficient device for the date indication which may be used, due to a modular structure, in a great number of different watches in order to represent easily readably the number of the month and eventually also the number of the day in large numbers.

Further advantages result from the characteristics specified in the dependent claims as well as from the description exposing in the following in detail the invention with the help of the figures.

The attached figures represent by way of example an embodiment of a device for the date indication according to the present invention.

The FIGS. 1*a* to 1*d* illustrate schematically in the plan view and in the section the arrangement of a first embodiment of the digit and decimal disks as well as of the corresponding programme disks and the switching phases of the indication of the month resulting thereby, a first form of a possible drive of the device being indicated in FIG. 1*a*.

The FIGS. 2*a* to 2*d* show schematically in the plan view and in the section the arrangement of a second embodiment of the digit and decimal disks as well as of the corresponding programme disks and the resulting switching phases of such an indication of the month.

Figure 3A:
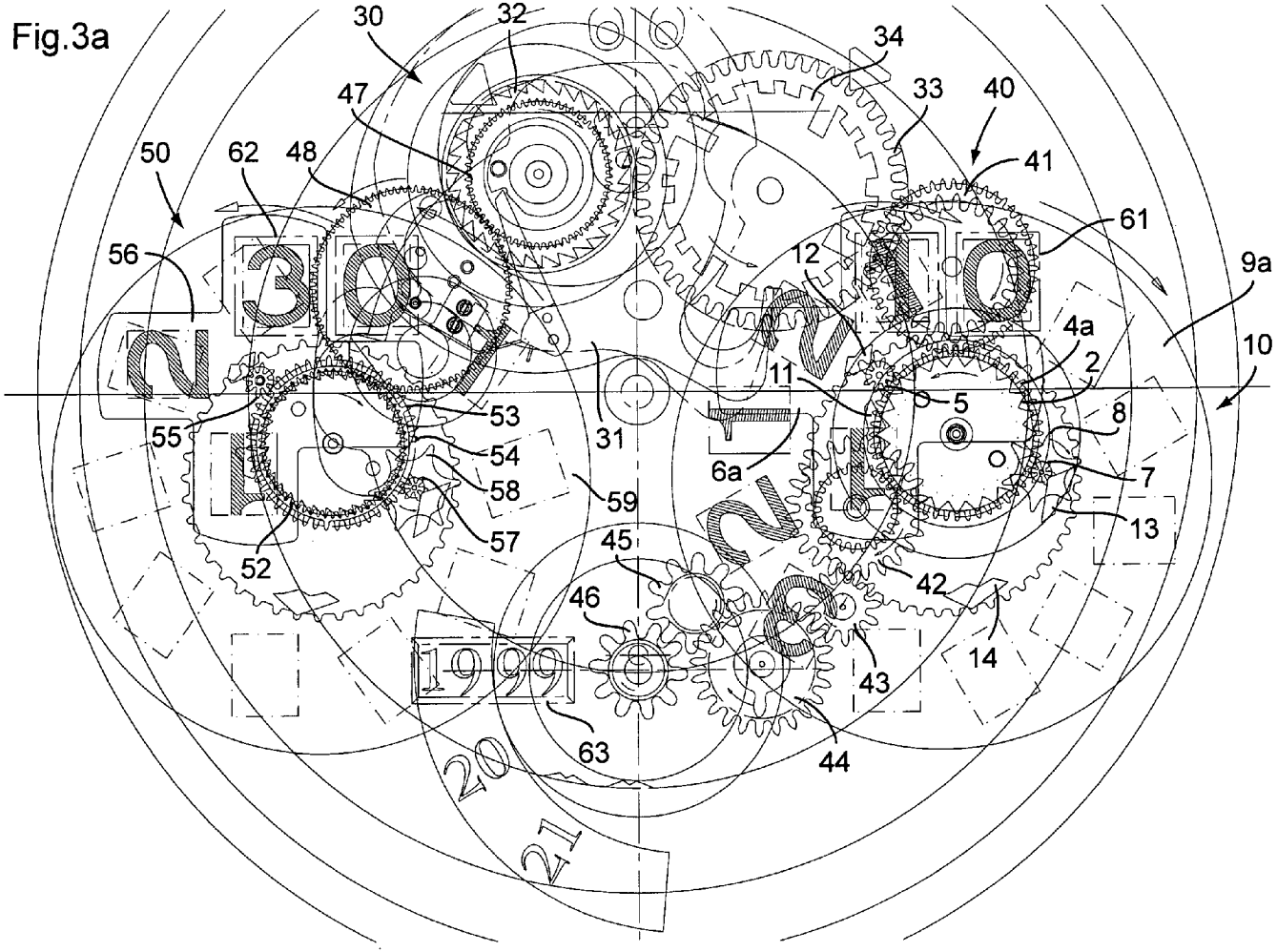

The FIG. 3*a* represents a second form of a possible drive of a device according to the present invention, both a known indication of the number of the day and an indication of the number of the year being driveable besides the device according to the invention in order to dispose of a complete date indication.

Figure 3B:
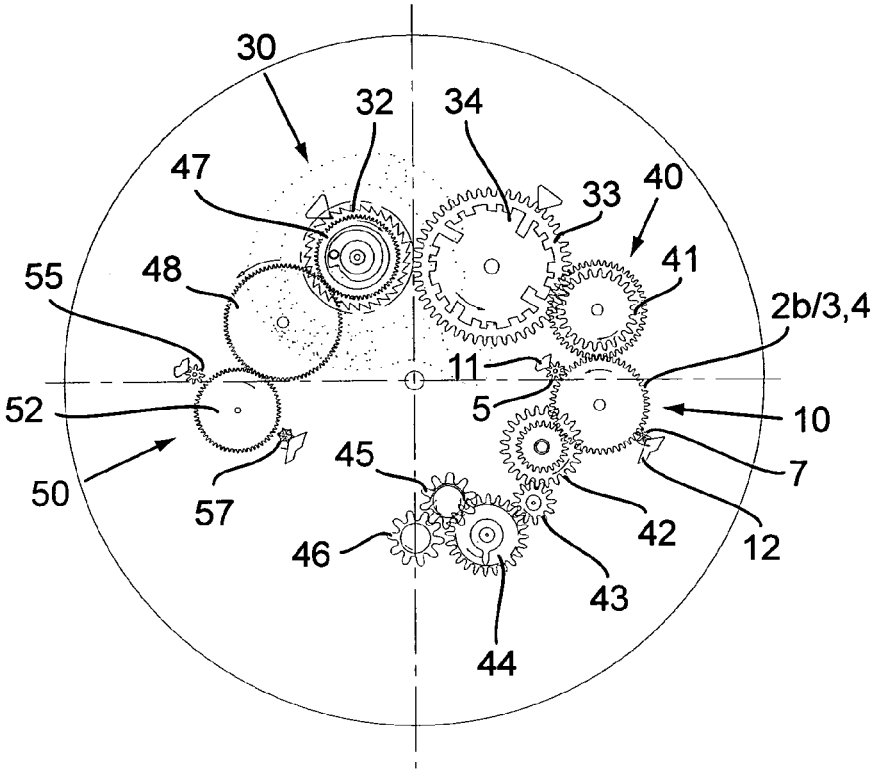
Figure 3C:
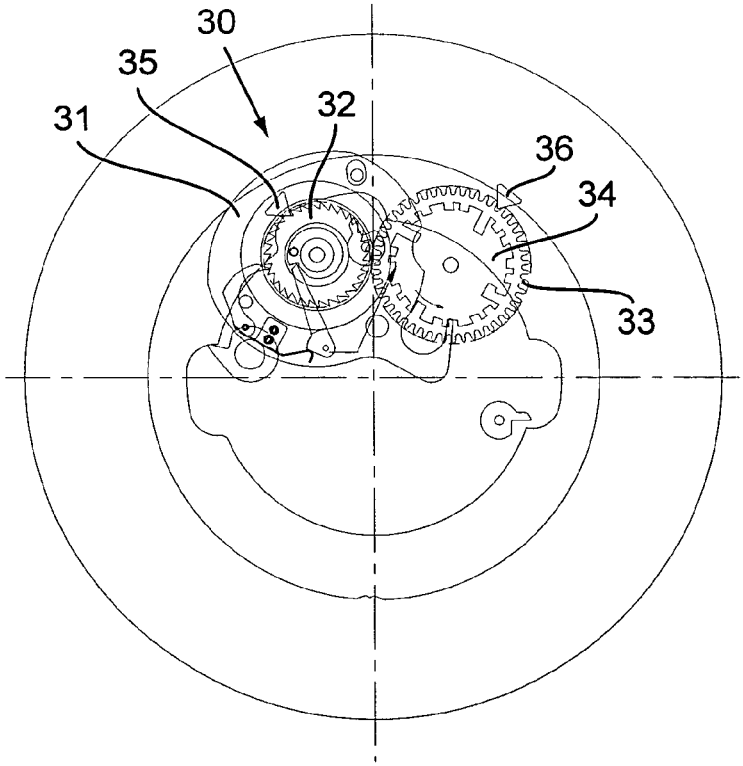

The FIG. 3*b* shows the gear-train of the FIG. 3*a* in detail, and the FIG. 3*c* illustrates closer the driving component of the FIG. 3*a*.

In the following the invention shall be described in detail with the help of the mentioned figures.

Figure 1B:
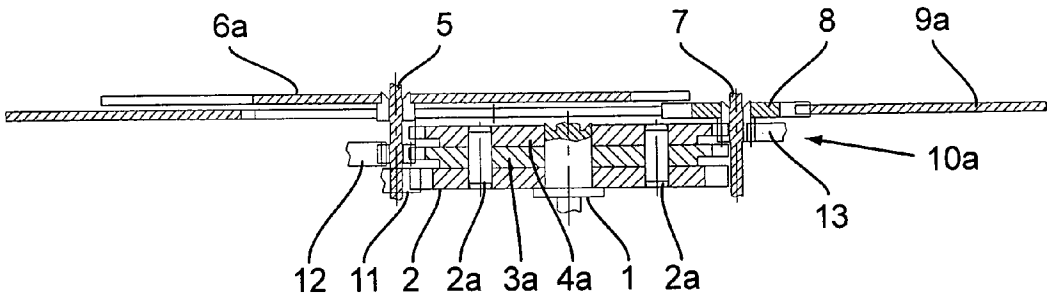

The device for the date indication in a watch, in particular a wrist watch, represented in the FIGS. 1*a* and 1*b* in the plan view and in the section comprises a digit disk 9 and a decimal disk 6, on each of which are printed a sequence of figures or numbers and which are arranged next to each other in parallel in such a manner that they overlap, as is perceptible from FIG. 3*a*, within the region of an indicating position 61 and thus allow to represent a two digit number, which is visible by an corresponding window in the dial of the watch. The disk of larger diameter is designed as a circular disk and the axis of rotation of the disk of smaller diameter is arranged within the outer peripheral contour of the disk of larger diameter. A digit programme wheel 4 as well as a decimal programme wheel 3 are each engaged with a digit pinion 7 as well as with a decimal pinion 5 and in this way control the switching operation of the digit disk 9 and the decimal disk 6. A programme drive wheel 2 passes on the driving force onto the digit 4 and decimal programme wheel 3, the programme drive wheel 2 and the programme wheels 3, 4 favourably being arranged coaxially. The exact design of these individual parts as well as their arrangement may now be done in different ways, but the digit 4 and decimal programme wheel 3 as well as the digit 9 and decimal disk 6 are generally arranged in such a manner that the latter are subject to a switching operation of one step per month in a predetermined succession or instead are subject to a switching operation break, in order to allow the indication of the number of the month. The different possibilities shall now be described in the following in detail, both the arrangement of the programme wheels and the disks and of the drive of the device having to be dealt.

Again with reference to the plan view and the section of the FIGS. 1*a* and 1*b* it shall be started with the description of a first embodiment 10*a* of the programme wheels 3*a*, 4*a* and the disks 6*a*, 9*a*.

In this case the digit disk 9*a* comprises on its side oriented towards the dial, evenly spaced in a concentric circle and approximately radially oriented, a sequence of figures from 1 to 9 followed by the FIGS. 0 to 2 respectively a multiple of it. The decimal disk 6*a* lying on top of it is for its part on its side oriented towards the dial, likewise evenly spaced in a concentric circle and approximately radially oriented, provided with the number 1 followed by one blank character or a zero respectively a multiple of it. A through window corresponding approximately to the dimension of a figure is each time arranged between the number 1 and the blank character or the zero in the decimal disk 6*a*, in order to allow for the actually indicated figure of the digit disk 9*a* lying underneath assigned to the decimal figure to appear in the region of the indicating position 61 of the watch, it therefore being possible to represent a two digit number through a corresponding window in the dial of the watch. For the represented arrangement with twice the FIG. 1 and two corresponding through windows the decimal disk 6*a* thus has a cross-like form. Here, the figures can be applied on the disks e.g. by printing or another procedure, the arrangement of the numbers depending on the direction of rotation of the disks and being opposite to this, the direction of rotation on its turn, indicated in the figures each time by an arrow, being in principle selectable arbitrarily. In principle it is also possible to replace the Arabic figures on the digit and decimal disk for example by symbols or Roman figures; in particular, the FIG. 1 of the decimal disk could be replaced by a smaller symbol, thus increasing the available space for the figures or symbols of the digit disk.

Figure 1C:
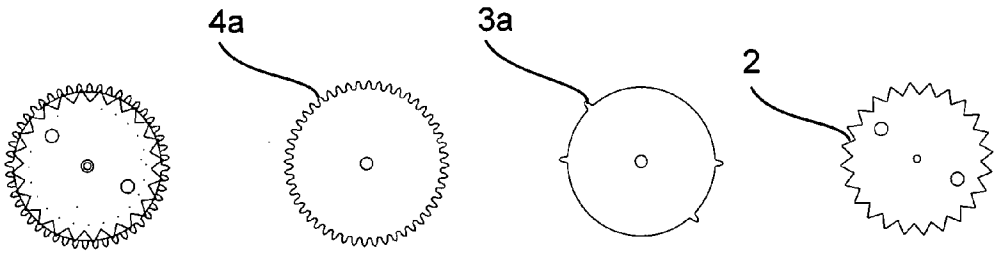

In the FIGS. 1*b* and 1*c* one understands the design and the arrangement of the indicator disks 6*a*, 9*a* and of the programme wheels 3*a*, 4*a* as well as their interaction.

In the present case the circular disk of larger diameter is realised as digit disk 9*a*. This is provided at its inner peripheral contour with an interior toothed rim, with which engages a digit star 8 solidly connected to the digit pinion 7, while the digit pinion 7 is engaged, as mentioned, with the digit programme wheel 4*a*. The digit disk 9*a* is thus controlled by the digit programme wheel 4*a* via the digit pinion 7 provided with a digit star 8.

The disk of smaller diameter is realised as decimal disk 6*a*, being in a torsion strengthened manner connected to the decimal pinion 5, which in turn is, as mentioned, engaged with the decimal programme wheel 3*a*. Thus, the decimal programme wheel 3*a* directly controls the decimal disk 6*a* via the decimal pinion 5. Alternatively to this realisation of the disk of smaller diameter, here the decimal disk 6*a*, it could, like the disk of larger diameter, also be designed as a circular disk and be provided at its inner peripheral contour with an interior toothed rim, with which engages a decimal star solidly connected to the decimal pinion 5 and being analogous to the digit star 8, this configuration not being shown in the figures. In this case, the decimal disk 6 wouldn't possess a cross-like form, but would resemble to a ring provided with through windows. Two such circular disks for digit 9 and decimal disk 6 can preferably have approximately the same diameter and can be arranged coaxially to each other, or may be arranged, analogous to the configuration shown in the FIG. 1*a*, eccentrically against each other, the axis of rotation of one disk being again arranged within the outer peripheral contour of the other disk in order to allow for a positioning of the indication area 61 also at the edge of the dial of the watch.

Moreover, the two programme wheels 3*a*, 4*a* are, as mentioned, arranged coaxially to the programme drive wheel 2 around the arbor 1, the digit 4*a* and the decimal programme wheel 3*a*, for example by means of pins 2*a*, being connected in a torsion strengthened manner and lying on top of each other with the programme drive wheel 2. The ensemble made of programme drive wheel 2 and programme wheels 3, 4 is advanced here, as will be described in more detail at a later place in the context of its drive, with one step per month.

Therefore, on the one hand, the digit disk 9*a* can be advanced by means of the digit programme wheel 4*a* via the digit pinion 7 and, on the other hand, the decimal disk 6*a* by means of the decimal programme wheel 3*a* via the decimal pinion 5 with one step per month, in the case of the configuration represented in FIG. 1*a* to 1*d* both these switching operations being triggered by the programme drive wheel 2 which is connected in a torsion strengthened manner to the programme wheels the 3*a*, 4*a*. In order to allow for the indication of the number of the month, the programme wheels 3*a*, 4*a* have an appropriate design, so that the disks 6*a*, 9*a* can be advanced by one step per month, whereby for the decimal disk 6*a* after a first switching operation a break in the switching operation for eight steps and after a second switching operation a break in the switching operation for two steps occurs.

To this effect, in the example of the FIG. 1*c* showing the programme wheel 2 and the digit 4*a* and decimal programme wheels 3*a* in superimposed position as well as separately, a digit 4*a* and a decimal programme wheel 3*a* with a tooth graduation of 48 teeth as well as a programme wheel 2 with a tooth graduation of 24 teeth have been chosen. Similar tooth graduations as multiples of the number 12 are however possible by tuning the arrangement of the disks 6, 9. The digit programme wheel 4*a* here really comprises 48 teeth and is advanced by one step per month with each monthly switching operation of the programme drive wheel 2 due to the torsion strengthened connection with it, this entailing a corresponding switching operation of the digit disk 9*a*. The decimal programme wheel 3*a* altogether comprises only four teeth and 44 tooth clearings, in between the 4 teeth each time 17 tooth clearings and 5 tooth clearings being arranged in alternating order. Thus, after a first switching operation into the position with the blank character respectively the zero visible in the indicating position 61 a break in the switching operation for eight steps occurs for the decimal disk 6*a* corresponding to the 17 tooth clearings and after a second switching operation into the position with the number 1 visible in the indicating position 61 a break in the switching operation for two steps occurs corresponding to the 5 tooth clearings. Due to the above choice of the tooth graduations, the programme drive wheel 2 with the programme wheels 3, 4 performs a semi-rotation per year, just as the decimal disk 6*a*, while the digit disk 9*a* turns once per year.

Figure 1D:
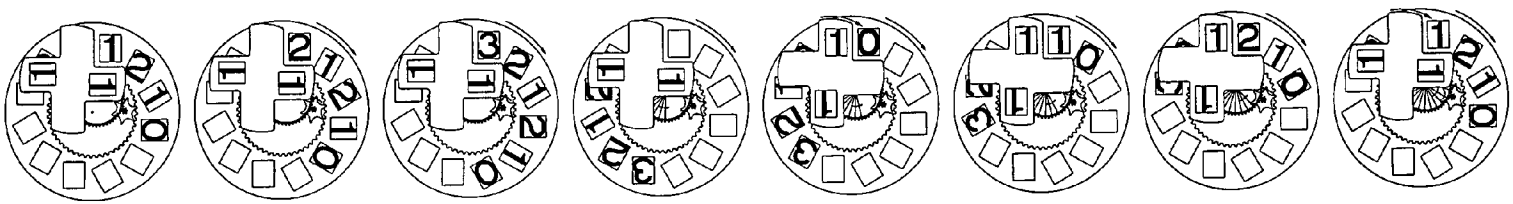

The corresponding switching phases are illustrated in the FIG. 1*d*, from which it becomes clear that the digit disk 9*a* in a continuous cycle monthly advances during the switching operation break of eight steps of the decimal disk 6*a* in eight steps from the FIG. 1 to 9 and during the switching operation break of two steps of the decimal disk 6*a* in two steps from the FIG. 0 to 2, which thus allows for the indication of the number of the month in digital, large sized manner.

In context with the FIGS. 1*a* to 1*d* it is still worth mentioning that the programme drive wheel 2, the digit pinion 7, the decimal pinion 5 and the digit disk 9 may each individually be arranged in a manner to be arrested by a notch 11, 12, 13 and 14 resiliently engaging its toothing in the inoperative position between two advancing steps, as is schematically indicated in FIG. 1*a*. Thus, these wheels may be secured if necessary against an unintentional displacement between two steps.

Figure 2A:
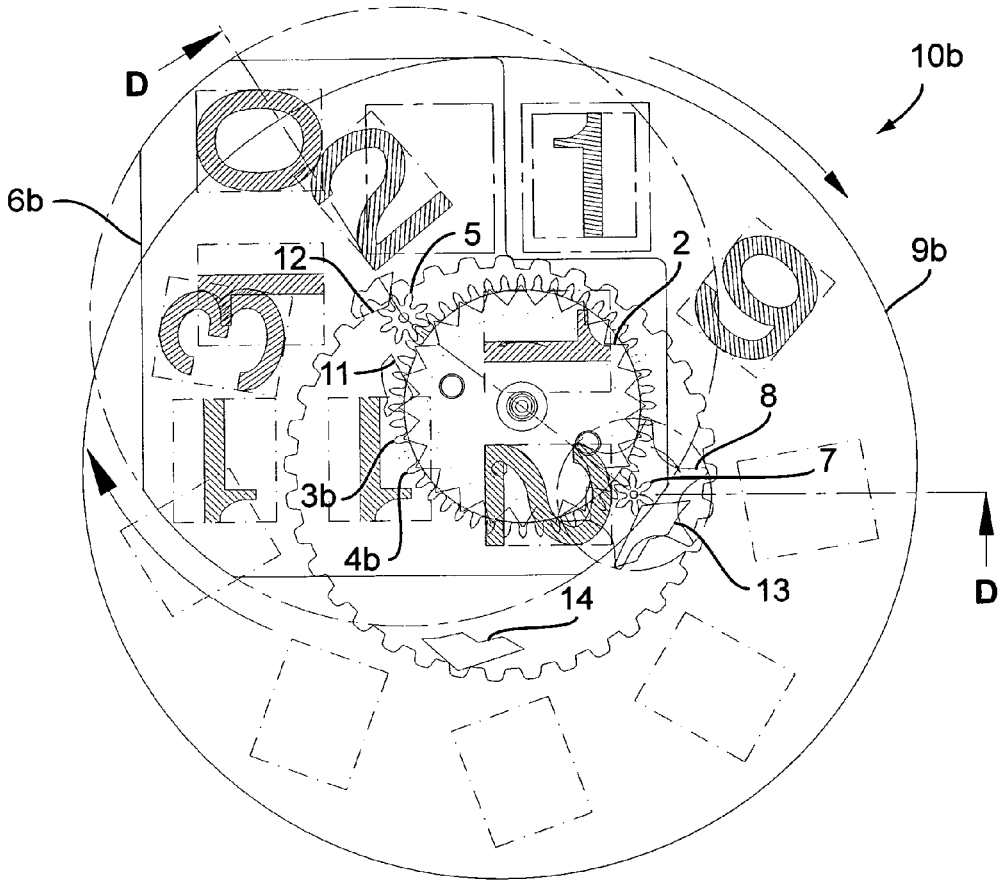
Figure 2B:
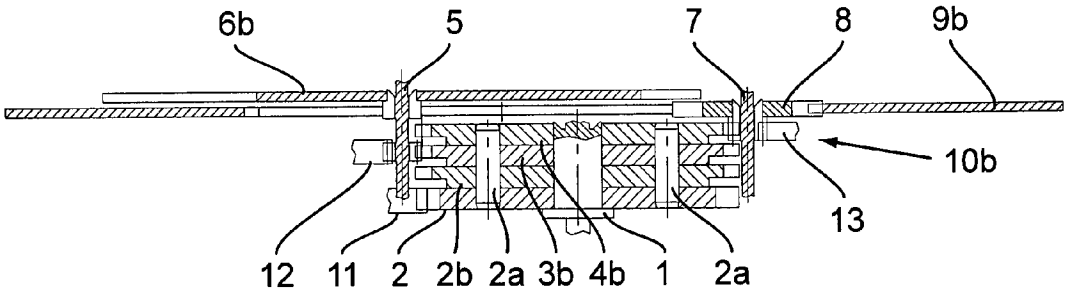

With reference to the plan view and the section of the FIGS. 2*a* and 2*b* the description now shall be continued with the illustration of a second embodiment 10*b* of the programme wheels 3*b*, 4*b* and the disks 6*b*, 9*b*.

What has been said before is still valid regarding the arrangement of the indication disks 6*b*, 9*b* and of the programme wheels 3*b*, 4*b* as well as regarding the principle of their interaction, only the realisation respectively the design of the indicator slides 6*b*, 9*b* and the programme wheels 3*b*, 4*b* deviates from the previous embodiment.

In this case the digit disk 9*b* comprises on its side oriented towards the dial, evenly spaced in a concentric circle and approximately radially oriented, a sequence of figures from 1 to 9 respectively a multiple of it. The decimal disk 6*b* comprises on its side oriented towards the dial, likewise evenly spaced in a concentric circle and approximately radially oriented, the numbers from 10 to 12 followed by one blank character or a zero respectively a multiple of it. A through window corresponding at least to the dimension of a figure on the digit disk 9*b* is arranged between the blank character or the zero and the sequence of numbers in the decimal disk 6*b*.

The digit disk 9*b* can be advanced by one step per month by means of the digit programme wheel 4*b* via the digit pinion 7 and the decimal disk 6*b* by means of the decimal programme wheel 3*b* via the decimal pinion 5, as in the previous embodiment. In the present example, however, due to the different arrangement of the disks, on the one hand a switching operation break for three steps occurs for the digit disk 9*b* after a switching operation of nine steps and on the other hand a switching operation of four steps as well as afterwards a switching operation break for eight steps occurs for the decimal disk 6*b* during the step following on the last switching operation of the digit disk 9*b* before its switching operation break respectively in the course of this last switching operation of the digit disk 9*b* before its switching operation break.

Figure 2C:
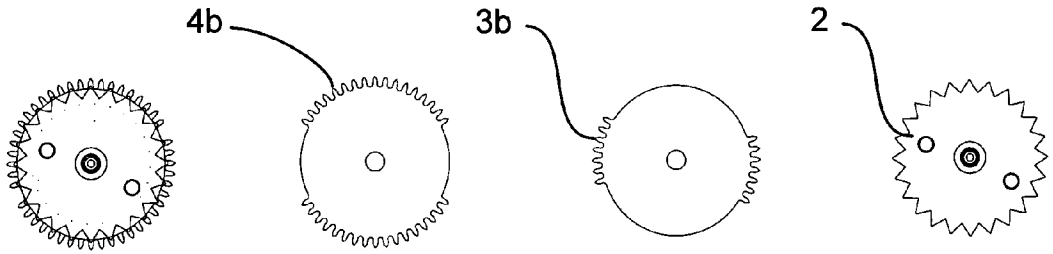
Figure 2D:
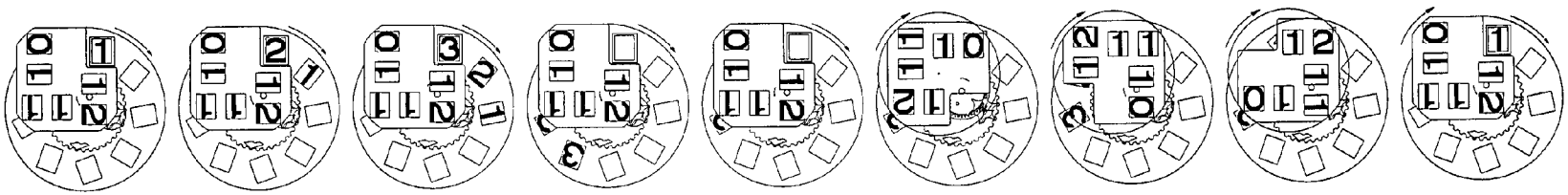

This is described in more detail on the basis the FIGS. 2*c* and 2*d*, which show the corresponding programme wheels 3*b*, 4*b* in superimposed position as well as separately in analogy to the FIGS. 1*c* and 1*d* and which illustrate the corresponding switching phases of the indication of the month.

Again, a corresponding digit 4*b* and a decimal programme wheel 3*b* with a tooth graduation of 48 teeth as well as a programme wheel 2 with a tooth graduation of 24 teeth can be chosen. This choice of the tooth graduations again has as a consequence that the programme drive wheel 2 connected to the programme wheels 3, 4 in a torsion strengthened manner, as its switching operation has been maintained, performs a semi-rotation per year with one step per month. The digit programme wheel 4*b* here actually comprises 34 teeth, each time 17 teeth in a series being separated by 7 tooth clearings, as represented in FIG. 2*c*. It is advanced with each monthly switching operation of the programme drive wheel 2 by one of its teeth by one step per month, which corresponds to two teeth on the digit programme wheel 4*b*. Alternatively, as will be described in more detail in the context with the drive and what is also valid for the embodiment 10*a* described above, the programme wheels 3, 4 may also be advanced in a direct way by one step per month, i.e. here by two teeth per month. Therefore, by means of the corresponding switching operation of the digit disk 9*b*, its nine numbers are indicated one after another, corresponding to a series of 17 teeth of the digit programme wheel 4*b*, before a switching operation break for three steps occurs, corresponding each time to 7 tooth clearings of the digit programme wheel 4*b*. The switching operation can begin here with the number 1 and end with the number 9, or begin with the number 2 and end with the number 1, the switching operation break of three steps beginning in each case thereafter. The decimal programme wheel 3*b* altogether comprises 14 teeth and 34 tooth clearings, the 7 teeth and 17 tooth clearings each being arranged one after another and in alternating order. If beginning the switching operation of the digit disk 9*b* with the number 1, the two programme wheels 3*b*, 4*b* are attached lying on top of each other in such a manner that after the 17 teeth of the digit programme wheel 4*b* and before the 7 teeth of the decimal programme wheel 3*b* one tooth clearing appears even in their superimposed position, as is evident in FIG. 2*c*. In this configuration, a switching operation break of three steps begins after the switching operation of the digit disk 9*b* of nine steps and the decimal disk 6*b* only begins its switching operation of four steps as well as afterwards a switching operation break for eight steps during the step following on the last switching operation of the digit disk 9*b* before its switching operation break. In other words, the change-over of the digit disk 9*b* from the number 9 visible at the indicating position 61 to the 1 and the one of the decimal disk 6*b* from the number 12 to the blank character with the window thus occur at the same time. However, if the beginning of switching operation of the digit disk 9*b* is chosen to be with the number 2, then the two programme wheels 3*b*, 4*b* are attached lying on top of each other in such a manner that in their superimposed position a tooth clearing appears before the 17 teeth of the digit programme wheel 4*b* and after the 7 teeth of the decimal programme wheel 3*b*. In this case, the decimal disk 6*b* begins its switching operation of four steps with a following switching operation break for eight steps already at the same time with the last switching operation of the digit disk 9*b* before its switching operation break, so that, in other words, the change-over of the digit disk 9*b* from the number 9 to the 1 and the one of the decimal disk 6*b* from the blank character with the window to the number 10 occur at the same time. The second variant of the programme wheels 3*b*, 4*b* thus allows for two different possibilities regarding their relative arrangement, which effectively cause the same result in the indication.

The corresponding switching phases are outlined, for the first one of the two possibilities of positioning of the programme wheels 3*b*, 4*b* mentioned above, in FIG. 2*d*. The decimal disk 6*b* and the digit disk 9*b* thus turn once per year, the respective switching operation breaks being coordinated with the switching operation of the other disk in such a manner that the indication of the number of the month in digital large size is possible.

Regarding the drive of this device for the date indication two possibilities are available, which are each applicable to both of the embodiments of the programme wheels and of the corresponding indication disks described above.

First, such a device can be driven in a simple, known manner by the motion-work. This possibility is indicated in FIG. 1*a*, where the programme drive wheel 2 can be advanced with one step per month by a first set of intermediate wheels 20 of the motion-work of the watch. The motion-work here drives a month star 21, which is connected coaxially and in a torsion strengthened manner with a month star-wheel 22. The month star 21 can be arrested by a notch 25 resiliently engaging its teeth against unintentional displacement from the inoperative position between two steps. The month star-wheel 22 in turn is engaged with a month control wheel 23, which carries a finger 24. This performs, like the month star 21 or eventually due to an adequate transmission of this first set of intermediate wheels 20, one revolution per month and therefore advances the programme drive wheel 2, with whose teeth it can engage, once per month by one tooth. This form of drive may be easily transferred to the embodiment 10*b* according to the FIGS. 2*a* to 2*d*.

Moreover, this device can favourably be driven and controlled by a perpetual calendar mechanism instead of the motion-work. For this purpose, for example a known calendar mechanism 30 of the type revealed in the patent specification EP 0 191 921 can be used, under alteration of some parts, in particular of certain intermediate wheels. The digit and the decimal programme wheel can be integrated into the set of intermediate wheels 40 belonging to the perpetual calendar mechanism 30. Therefore, the structure and the functioning of this known perpetual calendar mechanism 30 is to be dealt only briefly in the following, while there shall be described in particular the modifications necessary due to the combination of this mechanism with a device for the date indication according to the present invention.

This configuration is represented in the FIGS. 3*a* to 3*c*, the FIG. 3*a* showing schematically the entire arrangement in the plan view, while the FIG. 3*b* illustrates in detail the gear-train and the FIG. 3*c* the driving part of the FIG. 3*a*.

As described more in detail in the patent specification EP 0 191 921 and as represented in the FIGS. 3*a* as well as 3*c*, the perpetual calendar mechanism 30 comprises a lever 31 adapted to swing around its axle, which is moved back and forth by the clockwork once per day. Due to the daily swinging of the lever 31 a date wheel 32 is turned by one step per day by means of a pawl. At the same time, a pulping arm of the lever 31 radially rests against a month step disk 34 disposed in a swivelling manner, whose radial cuts at its periphery reflect the length of the months in a period of four years, in particular with consideration of the month February for a leap year. One of the 31 teeth of the date wheel 32 radially protrudes further in comparison to the others and once per month advances by one step a gear wheel 33 solidly connected to the month step disk 34 and likewise disposed in a swivelling manner. The interaction between the month step disk 34, the lever 31 and the date wheel 32, described in detail in the patent specification EP 0 191 921, provides for advancing the gear wheel 33 each time after the correct number of days for each month of the period of four years. The date wheel 32 as well as the gear wheel 33 can again be secured against automatic turning by means of notches 35 and 36 resiliently engaging in its teeth.

Departing from the gear wheel 33, the programme drive wheel 2 may be advanced by one step per month via a second set of intermediate wheels 40 by the perpetual calendar mechanism 30 of the watch, as a first pinion 41 simultaneously engages on the one hand via a first driver with the gear wheel 33 and on the other hand, by an appropriate height of the corresponding second driver of the pinion 41, with the digit 4*a* and the decimal programme wheel 3*a*, which are connected in a torsion strengthened manner and lying on top of each other with the programme drive wheel 2. While this is possible for the first embodiment 10*a* of the programme wheels 3*a*, 4*a* described above, since these form together a complete gear wheel ring, in the second embodiment 10*b* an additional drive wheel 2*b* has to be inserted concentrically into the block made up of programme drive wheel 2 and programme wheels 3*b*, 4*b* due to the tooth clearing appearing as described above in the superimposed programme wheels 3*b*, 4*b*. This is connected to these in a torsion strengthened manner and engages with the second driver of the pinion 41 instead of the programme wheels 3*b*, 4*b*, as is visible at best in the sectional view of the FIG. 2*b* or in the FIG. 3*a*. In the case of driving the device according to the invention by the perpetual calendar mechanism 30, the programme drive wheel 2 therefore primarily serves for protection against automatic turning between two steps by means of its triangle teeth and a corresponding notch 11 and could also be omitted for reasons of reduction of the height of the clockwork. Thus, like the drive of the device by the motion-work, also the drive by the perpetual calendar mechanism 30 is possible for both embodiments of the programme wheels 3, 4 and the indicator slides 6, 9.

The calendar mechanism 30 allows, as explained in detail in the patent specification EP 0 191 921, the complete date indication with the number of the day, the number of the month and number of the year. For this purpose, when using the device according to the present invention in cooperation with the perpetual calendar mechanism 30, the block made up of the programme drive 2, the digit 3 and the decimal programme wheels 4 connected to each other in a torsion strengthened manner as well as eventually of the additional drive wheel 2*b* works as part of the second set of intermediate wheels 40, the latter wheel 2*b* or the digit 4*a* and decimal programme wheels 3*a* engaging with a second pinion 42, which in turn drives an intermediate wheel 43. This drives a year indication module consisting of the wheels 44, 45 and 46 as well as of the corresponding display parts, which allows, as described in the patent specification EP 0 191 921, to represent the number of the year, of the decade and possibly of the century in the display area 63.

Next to that, also an indicator for the number of the day of the type known from the patent specification EP 0 529 191 can be built into the mechanism, in order to thus be able to represent both the number of the day and of the month in digital, large sized form, therefore a complete date indication with the number of the day, of the month and of the year being done in a device according to the invention with the number of the year available from the perpetual calendar mechanism. The indication of the number of the day here, as evident from FIG. 3*a*, is in a favourable manner likewise driven by the calendar mechanism 30, by disposing at the date wheel 32 a rotatable day wheel 47 concentrically and solidly connected to the first one, the day wheel 47 engaging with an intermediate day wheel 48. This is in engagement with a programme drive wheel 52 for the number of the day connected in a torsion strengthened manner with a digit 53 and a decimal programme wheel 54. The day programme drive wheel 52 may thus be advanced with one step per day by the calendar mechanism 30. The day digit 53 and the day decimal programme wheel 54 control, in a manner known from the patent specification EP 0 529 191, via a digit pinion 57 with a digit star 58 and a decimal pinion 55 being each in engagement with these the switching operation of a day digit disk 59 and a day decimal disk 56. Their arrangement likewise revealed in this patent specification thus allows the indication of the number of the day at a large size.

The device for the date indication according to the invention is adapted for the integration into watches, in particular wrist watches, of various type, preferentially into complex watches, due to its modular structure. This allows the realisation of watches with a large sized, digital indication of the number of the month and if necessary additionally with a large sized, digital indication of the number of the day as well as an indication of the year, where these indications can be driven either directly by the motion-work or by a perpetual calendar mechanism.

The invention claimed is:

1. Device for the date indication in a watch, in particular a wrist watch, with a digit disk (9) and a decimal disk (6), which each comprise a sequence of figures or numbers and are arranged in such a manner that they allow to represent a two digit number within the region of an indicating position (61), which is visible through a corresponding date window in the dial of the watch, the device comprising a digit programme wheel (4) as well as a decimal programme wheel (3) engaging respectively with a digit pinion (7) and a decimal pinion (5) to control the switching operation of the digit disk (9) and of the decimal disk (6) respectively, as well as with a programme drive wheel (2), which passes on the driving force onto the digit programme wheel (4) and decimal programme wheel (3), characterized by the fact that the digit (4) and decimal programme wheel (3) as well as the digit (9) and decimal disk (6) are arranged in such a manner that the latter are subject to a switching operation of one step per month in a predetermined succession or instead to a switching operation break, in order to allow for the indication of the number of the month.

2. Device according to claim 1, characterized by the fact that the digit disk (9*a*) comprises on its side oriented towards the dial, evenly spaced in a concentric circle and approximately radially oriented, a sequence of figures from 1 to 9 followed by the figures 0 to 2 respectively a multiple of it and the decimal disk (6*a*) on its side oriented towards the dial, evenly spaced in a concentric circle and approximately radially oriented, the number 1 followed by one blank character or a zero respectively a multiple of it, a through window corresponding approximately to the dimension of a figure being each time arranged in the decimal disk (6*a*) between the number 1 and the blank character or the zero.

3. Device according to claim 2, characterized by the fact that the digit disk (9*a*) can be advanced by one step per month by means of the digit programme wheel (4*a*) via the digit pinion (7) and the decimal disk (6*a*) by means of the decimal programme wheel (3*a*) via the decimal pinion (5), a switching operation break for eight steps occurring for the decimal disk (6*a*) after a first switching operation and a switching operation break for two steps after a second switching operation.

4. Device according to claim 1, characterized by the fact that the digit disk (9*b*) comprises on its side oriented towards the dial, evenly spaced in a concentric circle and approximately radially oriented, a sequence of figures from 1 to 9 respectively a multiple of it, and the decimal disk (6*b*) on its side oriented towards the dial, evenly spaced in a concentric circle and approximately radially oriented, the numbers from 10 to 12 followed by one blank character or a zero respectively a multiple of it, a through window corresponding approximately to the dimension of a figure being arranged in the decimal disk (6*b*) between the blank character or the zero and the sequence of numbers.

5. Device according to claim 4, characterized by the fact that the digit disk (9*b*) can be advanced by one step per month by means of the digit programme wheel (4*b*) via the digit pinion (7) and the decimal disk (6*b*) by means of the decimal programme wheel (3*b*) via the decimal pinion (5), a switching operation break for three steps occurring for the digit disk (9*b*) after a switching operation of nine steps and a switching operation of four steps as well as afterwards a switching operation break for eight steps occurring for the decimal disk (6*b*) during the step following on the last switching operation of the digit disk (9*b*) before its switching operation break respectively in the course of this last switching operation of the digit disk (9*b*) before its switching operation break.

6. Device according to claim 1, characterized by the fact that the digit (4) and decimal programme wheel (3) comprise a tooth graduation of 48 teeth.

7. Device according to claim 1, characterized by the fact that the digit disk (9) is a circular disk that has a larger diameter than the decimal disk (6), the axis of rotation of the decimal disk being arranged within the outer peripheral contour of the digit disk, and the digit disk being provided at its inner peripheral contour with an interior toothed rim which engages with a digit star (8) solidly connected to the digit pinion (7).

8. Device according to claim 7, characterized by the fact that the decimal disk (6) is connected to the decimal pinion (5) in a torsion strengthened manner.

9. Device according to claim 7, characterized by the fact that the decimal disk (6), is provided at its inner peripheral contour with an interior toothed rim which engages with a decimal star solidly connected to the decimal pinion (5).

10. Device according to claim 1, characterized by the fact that the digital disk (9) and the decimal disk (6) have approximately the same diameter and are arranged coaxially to each other.

11. Device according to claim 1, characterized by the fact that the programme drive wheel (2), the digit pinion (7), the decimal pinion (5) and/or the digit disk (9) may each be arrested in the inoperative position between two steps by a notch (11-14) resiliently engaging with its teething.

12. Device according to claim 1, characterized by the fact that the digit (3) and the decimal programme wheel (4) are connected in a torsion strengthened manner with the programme drive wheel (2).

13. Device according to claim 1, characterized by the fact that the programme drive wheel (2) can be advanced by one step per month via a first set of intermediate wheels (20) by the motion-work of the watch.

14. Device according to claim 1, characterized by the fact that the programme drive wheel (2) can be advanced by one step per month via a second set of intermediate wheels (40) by a perpetual calendar mechanism (30) of the watch, the calendar mechanism (30) allowing the complete date indication with the number of the day, the number of the month and the number of the year and the block made up of programme drive (2), digit (3) and decimal programme wheels (4) connected to each other in a torsion strengthened manner working as part of the second set off intermediate wheels (40).

15. Device according to claim 14, characterized by the fact that the indication of the number of the day is done via the calendar mechanism (30) by means of a programme drive wheel (52) for the number of the day connected in a torsion strengthened manner with a digit (53) and a decimal programme wheel (54), the digit (53) and the decimal programme wheel (54) each controlling via a digit pinion (57) and a decimal pinion (55) being in engagement with these the switching operation of a digit disk (59) and of a decimal disk (56) for the number of the day and the programme drive wheel (52) being adapted to be advanced by one step per day by the calendar mechanism (30).

16. Watch, in particular wrist watch, characterized by the fact that it comprises a device for the indication of the date according to claim 1.

17. Device according to claim 4, characterized by the fact that the digit disk (9*b*) can be advanced by one step per month by means of the digit programme wheel (4*b*) via the digit pinion (7) and the decimal disk (6*b*) by means of the decimal programme wheel (3*b*) via the decimal pinion (5), a switching operation break for three steps occurring for the digit disk (9*b*) after a switching operation of nine steps and a switching operation of four steps as well as afterwards a switching operation break for eight steps occurring for the decimal disk (6*b*) during the step following on the last switching operation of the digit disk (9*b*) before its switching operation break respectively in the course of this last switching operation of the digit disk (9*b*) before its switching operation break.

* * * * *